US007123223B2

(12) United States Patent
Moon

(10) Patent No.: US 7,123,223 B2
(45) Date of Patent: Oct. 17, 2006

(54) LIQUID CRYSTAL DISPLAY ADAPTIVE TO VIEWING ANGLE

(75) Inventor: Seung-Hwan Moon, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 194 days.

(21) Appl. No.: 10/077,055

(22) Filed: Feb. 19, 2002

(65) Prior Publication Data

US 2002/0149575 A1 Oct. 17, 2002

(30) Foreign Application Priority Data

Feb. 19, 2001 (KR) ..... 2001-008163

(51) Int. Cl.
*G06G 3/36* (2006.01)

(52) U.S. Cl. ..... 345/89; 345/207; 345/690

(58) Field of Classification Search ..... 345/87–104, 345/204, 207, 690, 901, 905; 348/674
See application file for complete search history.

(56) References Cited

U.S. PATENT DOCUMENTS 4,319,237 A * 3/1982 Matsuo et al. ..... 345/101
5,250,937 A * 10/1993 Kikuo et al. ..... 345/89
6,323,847 B1 * 11/2001 Kaneko et al. ..... 345/204

FOREIGN PATENT DOCUMENTS

| | | |
|---|---|---|
| JP | 11-338575 | * 12/1999 |
| KR | 1997-0017140 | 4/1997 |
| KR | 1999-0068951 | 9/1999 |

* cited by examiner

*Primary Examiner*—Lun-yi Lao

(57) ABSTRACT

Disclosed is an LCD capable of adaptively selecting a gamma curve based on a viewing angle. The LCD includes: a viewing angle detector for detecting the viewing angle of an LCD panel to generate information about the viewing angle, and a gamma curve determiner for selecting a gamma curve corresponding to the information of the viewing angle and controlling the gray level with a gamma voltage value defined by the selected gamma curve. The viewing angle detector has a driving voltage generator and a voltage divider. The driving voltage generator outputs a gate-on/off voltage and an analog driving voltage based on an externally input power, and the voltage divider drops the level of the gate-on voltage to generate a first voltage. A viewing angle generator outputs information about the viewing angle based on the analog driving voltage and the first voltage.

14 Claims, 6 Drawing Sheets

LIQUID CRYSTAL DISPLAY ADAPTIVE TO VIEWING ANGLE

BACKGROUND OF THE INVENTION (a) Field of the Invention

The present invention relates to a liquid crystal display adaptive to a viewing angle. More specifically, the present invention relates to a liquid crystal display capable of adaptively selecting a gamma curve based on the viewing angle.

(b) Description of the Related Art

In general, a liquid crystal display (LCD) has a transparent electrode installed on the inner sides of two substrates in various display modes, e.g., in a twist nematic (TN) display mode in which liquid crystal molecules having a positive (+) dielectric isotropy are arranged in parallel with the substrates and twisted with an angle difference of almost 90 degrees between the substrates, and a super twist nematic (STN) display mode in which the liquid crystal molecules are arranged in a similar way to a TN display mode but twisted with an angle difference of 180 to 240 degrees between the substrates.

FIG. 1 is a diagram illustrating a transmissivity depending on an applied voltage in a normally white mode-type TN liquid crystal.

Referring to FIG. 1, the curves graph the transmissivity based on a voltage applied from the front of the LCD (i.e., at an angle of 0 degrees) and at a predetermined angle from the LCD, for example, at a viewing angle of −20 degrees, respectively.

Thin film transistor (TFT) LCD products with such a characteristic of the TN LCD mode have a problem in displaying grays based on the viewing angle. Namely, those grays as normally viewed from the front of the LCD panel are difficult to see at a viewing angle other than zero degrees.

As such, the range of the viewing angle is more significant in a color display relative to a black-and-white one. The movement of the observer varies the display contrast and color, since the viewing angle is not uniform in all directions unless the liquid crystal molecules displaying optical double refraction are in a completely parallel or vertical array.

Besides, the LCD module is designed to apply a constant voltage to the liquid crystals in order to optimize the gray representation from the front side of the LCD, which gives rise to a problem that the gray turns black even with a lowest voltage.

The LCD panel cannot maintain an accurate gray level based on the viewing angle, for example, in a notebook computer in which the user must open the LCD panel wide, in which case the LCD panel has a limitation in the wide-open area during use due to the viewing angle.

SUMMARY OF THE INVENTION

It is an object of the present invention to provide a liquid crystal display (LCD) adaptive to a viewing angle designed to adaptively select a gamma curve based on the viewing angle and to thereby overcome the problem with the prior art concerning a decrease in the gray level.

In one aspect of the present invention, there is provided an LCD adaptive to a viewing angle that includes: a driving voltage generator for generating first and second voltages based on an externally input power; a voltage divider for converting a level of the second voltage based on the viewing angle of the LCD panel to generate a third voltage; a viewing angle generator for generating information about the viewing angle based on the first and third voltages; and a gamma curve determiner for selecting a gamma curve corresponding to received information about the viewing angle, and controlling a gray level with a gamma voltage value defined by the selected gamma curve. Preferably, the voltage divider comprises a variable resistor for variably generating a resistance value based on the viewing angle of the LCD panel, and outputs the third voltage using the variable resistance.

Preferably, the rotational axis of the variable resistor is connected to that of a hinge supporting the LCD module so as to automatically select the gamma curve by operation of a user. Preferably, the variable resistor is of a dial or sliding type.

In another aspect of the present invention, there is provided an LCD adaptive to a viewing angle that includes: a driving voltage generator for generating first and second voltages based on an externally input power; a decoder for decoding information of the viewing angle as received by operation of a user; a voltage divider comprising a plurality of resistors, for selecting any one of the resistors based on the decoded information of the viewing angle, and converting a level of the second voltage based on the selected resistor to generate a third voltage; a viewing angle generator for generating information about the viewing angle based on the first and third voltages; and a gamma curve determiner for selecting a gamma curve corresponding to received information about the viewing angle, and controlling a gray level with a gamma voltage value based on the selected gamma curve.

In still another aspect of the present invention, there is provided an LCD adaptive to a viewing angle that includes: a driving voltage generator for generating a first voltage based on an externally input power; a decoder for decoding information of the viewing angle as received by operation of a user; a power selector comprising a plurality of voltage sources, for selecting any one of the voltage sources based on the decoded information of the viewing angle to generate a second voltage; a viewing angle generator for generating information about the viewing angle based on the first and second voltages; and a gamma curve determiner for selecting a gamma curve corresponding to the received information about the viewing angle, and controlling a gray level with a gamma voltage value based on the selected gamma curve.

In still further another aspect of the present invention, there is provided an LCD adaptive to a viewing angle that includes: a driving voltage generator for generating an analog driving voltage based on an input power externally received via a first input; a viewing angle generator for generating information about the viewing angle with a level of the analog driving voltage dropped based on the viewing angle, and feeding the level-dropped analog driving voltage back to a second input of the driving voltage generator; and a gamma curve determiner for selecting a gamma curve corresponding to the received information about the viewing angle, and controlling a gray level with a gamma voltage value based on the selected gamma curve.

The LCD adaptive to a viewing angle detects the viewing angle of the LCD panel, selects a gamma curve based on the detected viewing angle, and applies a liquid crystal gamma voltage using the selected gamma curve, thereby overcoming a problem in regard to a reduction of the gray level due to the variation of the viewing angle.

BRIEF DESCRIPTION OF THE DRAWINGS

The accompanying drawings, which are incorporated in and constitute a part of the specification, illustrate an embodiment of the invention, and, together with the description, serve to explain the principles of the invention.

DETAILED DESCRIPTION OF THE PREFERRED EMBODIMENTS

In the following detailed description, the preferred embodiment of the invention has been shown and described, simply by way of illustration of the best mode contemplated by the inventor(s) of carrying out the invention. As will be realized, the invention is capable of modification in various obvious respects, all without departing from the invention. Accordingly, the drawings and description are to be regarded as illustrative in nature, and not restrictive.

Figure 1:
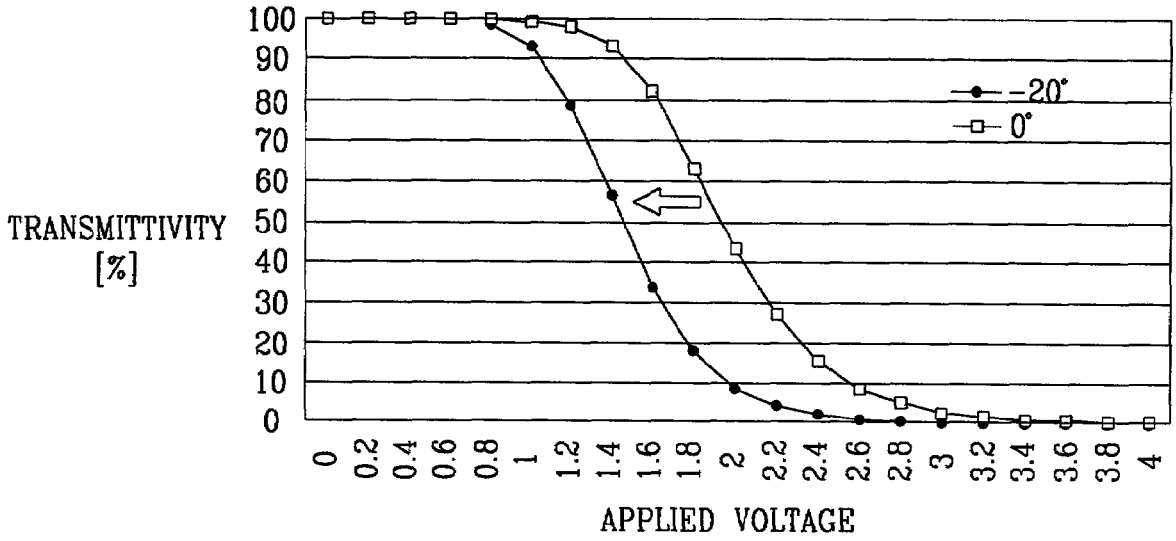
FIG. 1 is a diagram illustrating a transmissivity based on an applied voltage in a normally white mode-type TN liquid crystal according to prior art.
Figure 2:
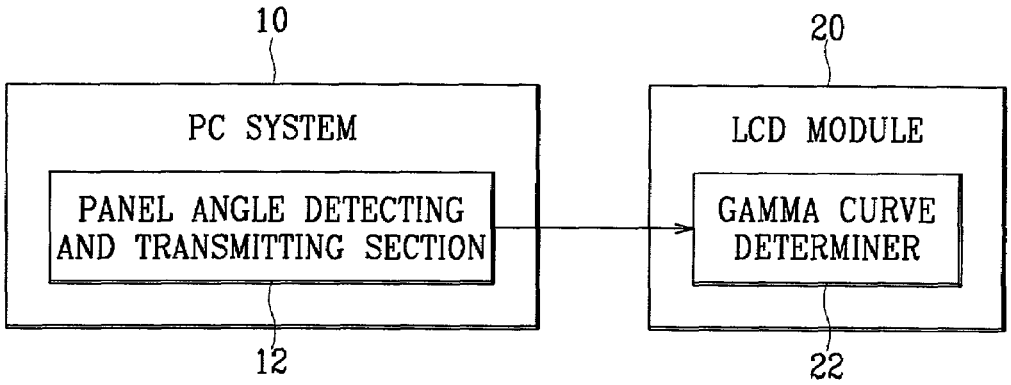
FIG. 2 is a diagram illustrating an LCD that selects a gamma curve based on a viewing angle in accordance with the present invention.

FIG. 2 is a diagram illustrating an LCD that selects a gamma curve based on a viewing angle in accordance with the present invention.

Referring to FIG. 2, the LCD that selects a gamma curve based on a viewing angle in accordance with the present invention comprises a PC system 10 and an LCD module 20, and it controls the gray level with a gamma curve adaptively selected based on the viewing angle.

The PC system 10 comprises a panel angle detecting and transmitting section 12 for detecting the angle of the LCD panel, and generates information about the detected angle to the LCD module 20. In particular, the PC system as used herein is such a system, for example, a notebook computer that is designed to freely control the open angle of the LCD panel.

The LCD module 20 comprises a gamma curve determiner 22 for selecting a gamma curve based on the information about the detected angle received from the PC system 10 and using the selected gamma curve to control the gray level.

The angle detection method used in the PC system 10 according to the present invention may be either a manual or an automatic method. For example, the manual angle detection method that involves the user determining the viewing angle includes a method causing the user to enter a desired viewing angle on a keyboard, and a method causing the user to select the viewing angle with a defined structure mounted on the PC or monitor, preferably with a variable resistor.

While on the other hand, the automatic angle detection method includes a method using the above-mentioned structure mounted on a hinge supporting the LCD module 20 on the PC system 10 to generate information about the rotational angle of the LCD panel based on that of the hinge to the LCD module 20.

An apparatus for selecting a gamma curve based on the information about the viewing angle received from the LCD module 20 is designed to select an adequate gamma curve based on the information about the viewing angle fed into the LCD module 20.

Now, a detailed description will be given as to an LCD for selecting a gamma curve based on the viewing angle of the LCD panel by way of different embodiments of the present invention.

Figure 3:
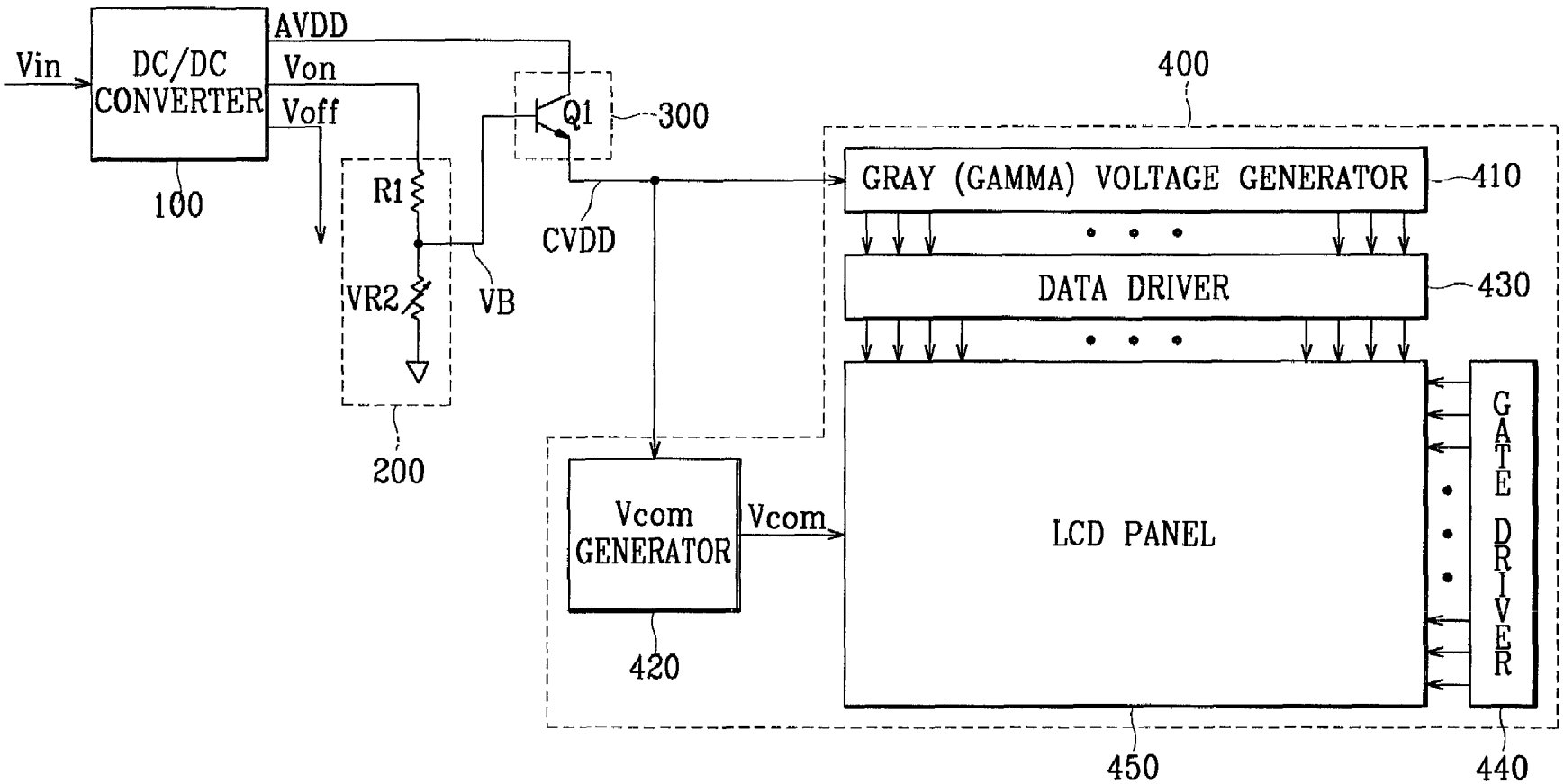
FIG. 3 is a diagram illustrating an LCD adaptive to a viewing angle in accordance with a first embodiment of the present invention.

FIG. 3 is a diagram illustrating an LCD adaptive to a viewing angle in accordance with a first embodiment of the present invention.

Referring to FIG. 3, the LCD adaptive to the viewing angle in accordance with the first embodiment of the present invention comprises a driving voltage generator 100, a voltage divider 200, a viewing angle generator 300, and an LCD module 400.

The driving voltage generator 100 comprises a DC/DC converter, and upon receiving an input voltage Vin, generates an analog driving voltage AVDD of the LCD to the viewing angle generator 300 as well as a gate-on/off voltage Von/Voff for turning on/off the TFT. The driving voltage generator 100 applies the gate-on voltage Von to the voltage divider 200.

The voltage divider 200 comprises a constant resistor R1 and a variable resistor R2 connected in series, divides the level of the gate-on voltage Von, and outputs a third voltage $V_B$ to the viewing angle generator 300.

The viewing angle generator 300 comprises an npn-type bipolar transistor Q1, and generates a voltage CVDD to the LCD module 400 based on the third voltage $V_B$ received at the base terminal and the voltage AVDD received at the collector terminal. Although it has been described that the present invention uses a bipolar transistor, a MOS transistor may also be used.

The LCD module 400 comprises a gray voltage generator (or gamma voltage generator) 410, a common electrode voltage generator 420, a data driver 430, a gate driver 440, and an LCD panel 450, and selects a gamma curve adaptive to the viewing angle based on the voltage CVDD received from the viewing angle generator 300.

More specifically, the gray voltage generator 410 receives the voltage CVDD and generates positive and negative gamma voltages, between which the voltage gap is decreased or increased, to the data driver 430.

The common electrode voltage generator 420 receives the voltage CVDD and generates a linearly varying common electrode voltage Vcom to the LCD panel 450. For example, the common electrode voltage generator 420, which comprises two serial resistors, receives the voltage CVDD via the one terminal and a reference voltage (or ground) via the other terminal, and drops the level of the voltage CVDD through resistance-based voltage division to generate the common electrode voltage Vcom.

As such, the use of the linearly varied common electrode voltage Vcom maintains the image quality such as avoiding flicker. The LCD panel as used herein may have TN or STN mode-type liquid crystals.

Now, a detailed description will be given as to an operation of the LCD shown in FIG. 3.

First, the DC/DC converter 100 receives a power Vin, and generates a gate-on voltage to turn on the TFT, a gate-off voltage to turn off the TFT, and a voltage AVDD to perform an analog driving of the LCD. The gate-on voltage Von is a high voltage of about 20 volts, the gate-off voltage Voff being about −7 volts.

The gate-on voltage divided by the resistor R1 and the variable resistor VR2 between the gate-on voltage Von and the ground terminal is applied to the base of the bipolar transistor Q1. Namely, the base electrode voltage $V_B$ of the bipolar transistor Q1 is given by Equation 1.

$$V_B = \frac{VR_2}{R_1 + R_2} \cdot V_{on} \quad \text{[Equation 1]}$$

Since the collector electrode voltage of the bipolar transistor Q1 is an analog driving voltage AVDD, the emitter electrode voltage VE of the bipolar transistor Q1 is given by Equation 2.

$$V_E \leqq AVDD - V_{CE} \quad \text{[Equation 2]}$$

The range of the base electrode voltage $V_B$ is defined as Equation 3 under the base-emitter electrode voltage $V_{BE}$ of the bipolar transistor Q1.

$$0V < V_B < V_E + V_{BE} = AVDD - V_{CE} + V_{BE} \quad \text{[Equation 3]}$$

Figure 4:
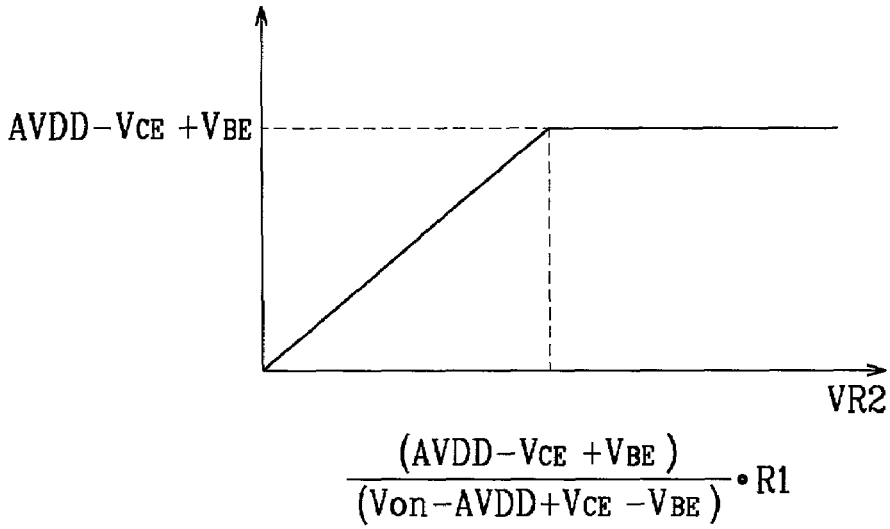
FIG. 4 is a diagram illustrating the range of a base electrode voltage depending on the variable resistance value shown in FIG. 3.

The relationship between Equations 1 and 3 can be graphed as shown in FIG. 4. Namely, the range of the base electrode voltage increases with an increase in the base electrode voltage and becomes constant with the variable resistance value VR2 reaching $[AVDD-V_{CE}+V_{BE}]\cdot R1/[Von+AVDD-V_{CE}+V_{BE}]$.

With the base electrode voltage $V_B$, the emitter electrode voltage $V_E$, i.e., viewing angle voltage CVDD, is given by Equation 4.

$$V_E = CVDD = V_B - V_{BE} \quad \text{[Equation 4]}$$

It is therefore possible to increase or decrease the gap between positive (+) and negative (−) gamma voltages based on the viewing angle voltage CVDD dependent upon the external variable resistance value VR2 in the gamma voltage generator 410 that divides the viewing angle voltage CVDD by the resistance. That is, a gamma curve can be regulated.

Similarly, resistance-type division of the viewing angle voltage CVDD results in the common electrode voltage Vcom, so that the common electrode voltage Vcom can also be varied linearly depending on the variable viewing angle voltage CVDD, thus maintaining the image quality such as avoiding flicker.

Figure 5:
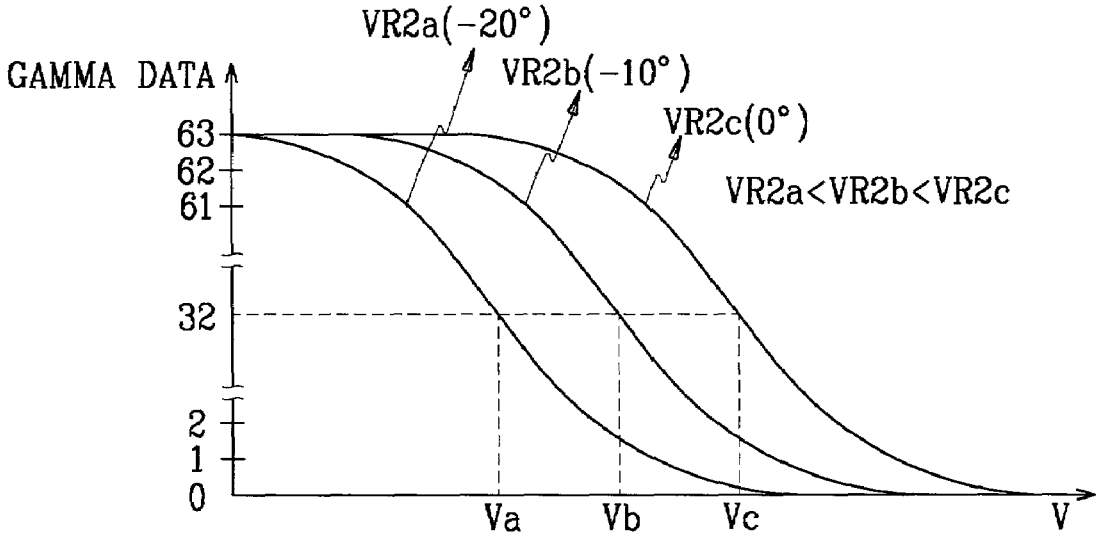
FIG. 5 is a diagram illustrating a liquid crystal applied voltage determined based on gamma data associated with the variable resistance value shown in FIG. 3.

FIG. 5 is a diagram illustrating a liquid crystal applied voltage determined based on gamma data associated with the variable resistance value VR2 shown in FIG. 3.

As shown in FIG. 5, the applied voltage that has to be determined depending on the gamma data can be controlled with a variable resistor.

That is, a resistor VR2*c* is connected to the LCD module when the user views the LCD panel straight on (i.e., at a viewing angle of 0 degrees), a voltage $V_B$ resulting from the resistor VR2*b* is applied when the LCD panel is viewed at a viewing angle of −10 degrees, and a resistor VR2*a* is connected to the LCD module when the LCD panel is viewed at a viewing angle of −20 degrees.

As described above, according to the first embodiment of the present invention, the gamma curve based on the viewing angle of the LCD panel can be controlled with the variable resistor VR2. With the LCD panel of a notebook computer, for example, opened wide to a predetermined angle, the voltage applied to the liquid crystals can be varied to the most suitable gamma curve of the corresponding viewing angle. This overcomes the narrow range of the gray representation resulting from the viewing angle in the LCD panel and enables provision of notebook computers convenient for viewing by of the user.

The variable resistor as stated in the first embodiment of the present invention may be mounted on a hinge supporting the LCD panel of a notebook computer, or the like. Namely, the rotational axis of the hinge is connected to that of the variable resistor and thereby rotation of the hinge at a predetermined angle rotates the variable resistor at the same angle and thereby generates a resistance value associated with that angle.

Furthermore, the variable resistor may comprise a dial or sliding-type resistor, which is provided on the LCD module or the computer body for the user to freely select the viewing angle of the LCD panel.

Figure 6:
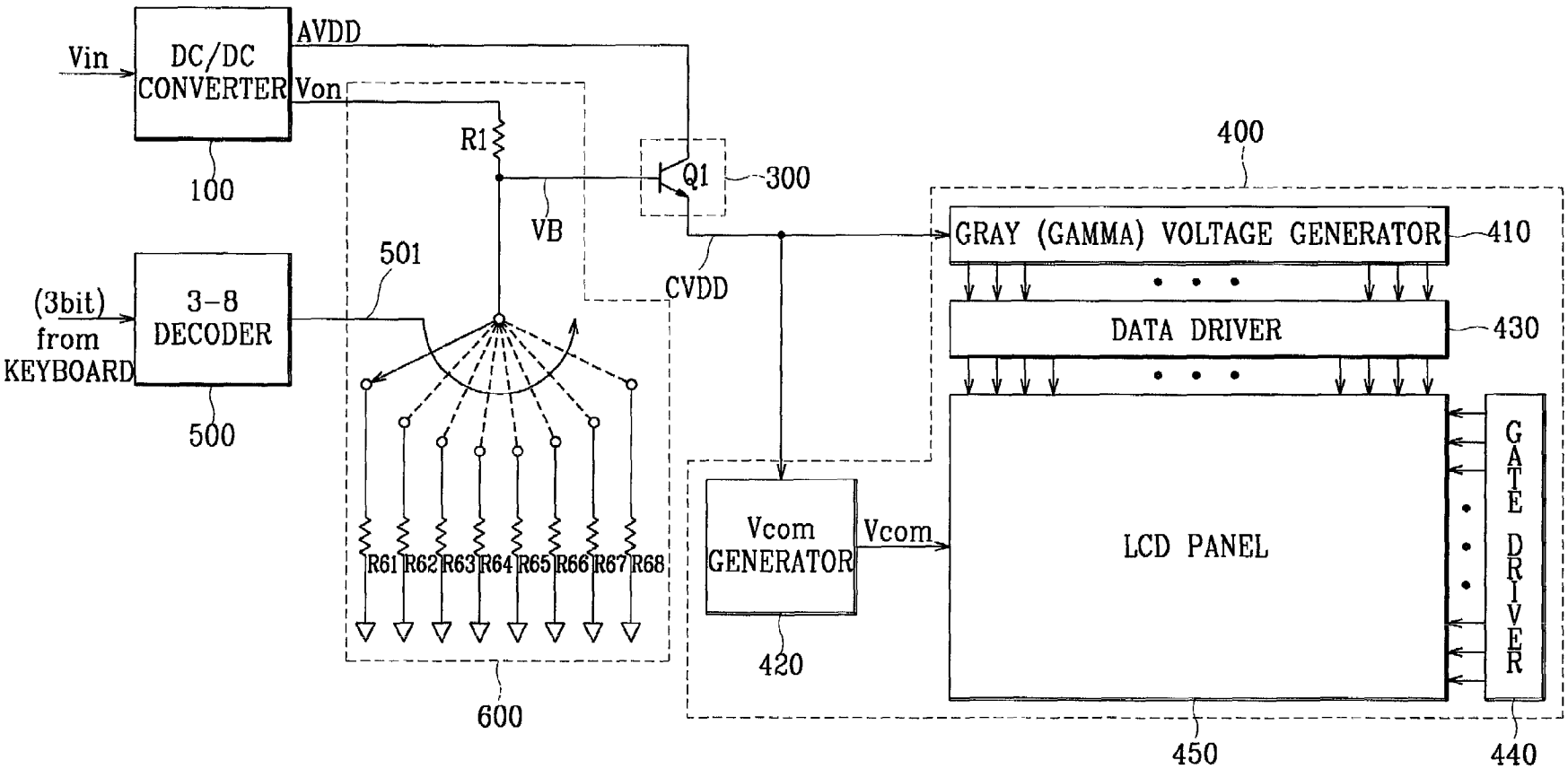
FIG. 6 is a diagram illustrating an LCD adaptive to a viewing angle in accordance with a second embodiment of the present invention.

FIG. 6 is a diagram illustrating an LCD adaptive to a viewing angle in accordance with a second embodiment of the present invention.

Referring to FIG. 6, the LCD adaptive to a viewing angle in accordance with the second embodiment of the present invention comprises a driving voltage generator 100, a viewing angle generator 300, an LCD module 400, a decoder 500, and a resistance selector 600. The driving voltage generator 100, the viewing angle generator 300, and the LCD module 400 perform the same operations as described in FIG. 3.

The decoder 500 decodes data about the viewing angle received from, for example, a keyboard as operated by the user, and generates a switching signal 501 to the resistance selector 600. For example, three-bit data input to the decoder 500 results in eight switching signals.

The resistance selector 600 comprises a first resistor connected to the gate-on voltage Von output from the driving voltage generator 100, a plurality of resistors R61, R62, . . . , R68, and a switch for selecting one of the resistors.

In operation, the resistance selector 600 selects any one of the resistors based on the switching signal 501 received from the decoder 500 and divides the gate-on voltage Von by the selected resistance and the first resistance R1. The divided gate-on voltage Von is then applied to the viewing angle generator 300.

In accordance with the above-described second embodiment of the present invention, as the user enters information about the viewing angle using a keyboard or the like, any one of the resistors is selected to increase or decrease the gap between positive (+) and negative (−) gamma voltages based on the level of the viewing angle voltage CVDD for controlling the viewing angle. That is, the gamma curve is controlled.

Similarly, division of the viewing angle voltage CVDD by the resistance generates the common electrode voltage Vcom that determines flickering, so that the common electrode voltage Vcom is also varied linearly depending on the varying viewing angle voltage CVDD, thereby maintaining the image quality such as avoiding flicker.

Figure 7:
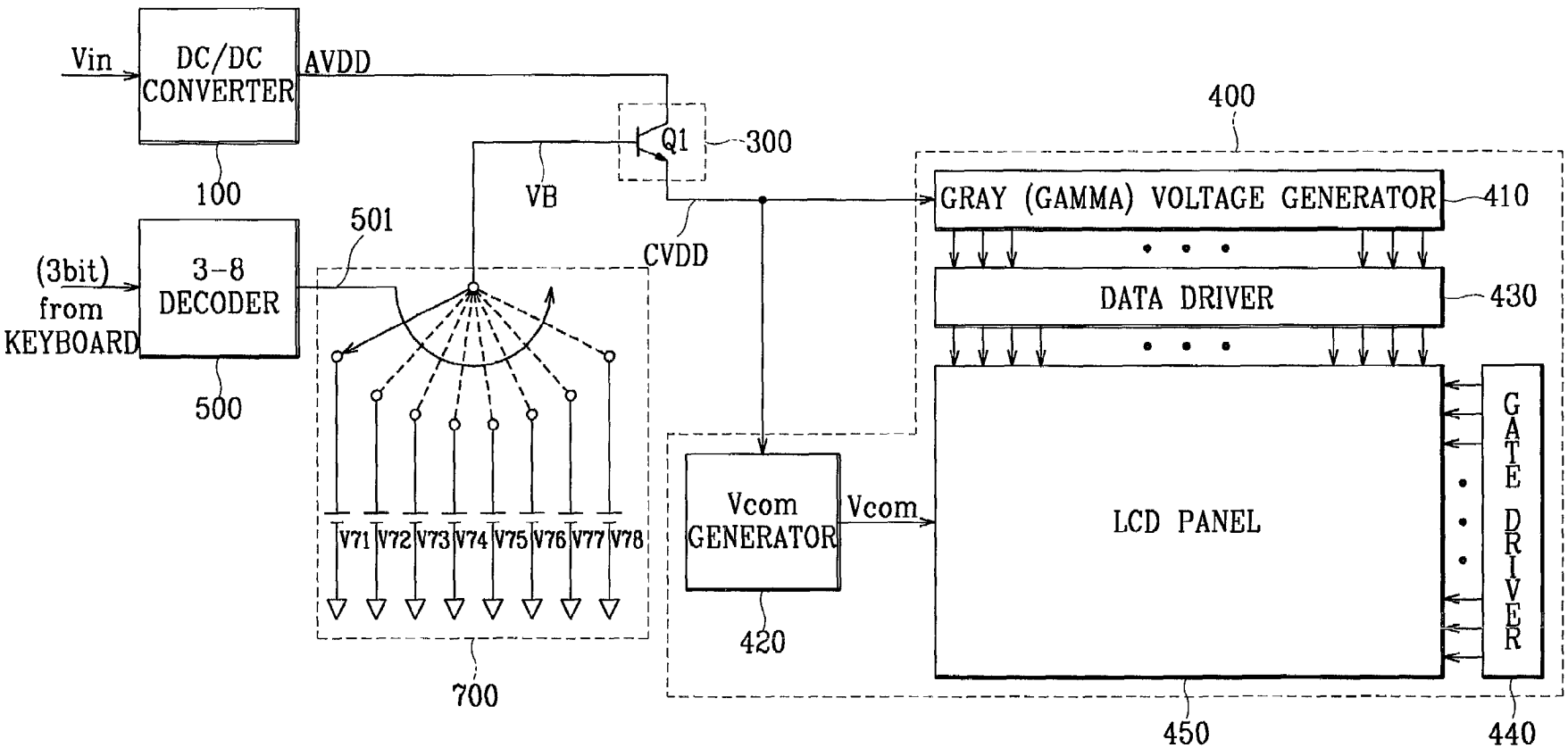
FIG. 7 is a diagram illustrating an LCD adaptive to a viewing angle in accordance with a third embodiment of the present invention.

FIG. 7 is a diagram illustrating an LCD adaptive to a viewing angle in accordance with a third embodiment of the present invention.

Referring to FIG. 7, the LCD adaptive to a viewing angle in accordance with the third embodiment of the present invention comprises a driving voltage generator 100, a viewing angle generator 300, an LCD module 400, a decoder 500, and a power selector 700. The viewing angle generator 300, the LCD module 400, and the decoder 500 will not be further described herein.

The power selector 700 comprises a plurality of powers V71, V72, . . . , V78, and a switch for selecting one of the powers, and selects any one of the powers based on the switching signal 501 received from the decoder 500. The selected power is then applied to the viewing angle generator 300.

In accordance with the above-described third embodiment of the present invention, as the user enters information about the viewing angle using a keyboard or the like, any one of the powers is selected to control the viewing angle voltage CVDD and increase or decrease the gap between positive (+) and negative (−) gamma voltages based on the controlled viewing angle voltage CVDD. That is, the gamma curve is controlled.

Similarly, division of the viewing angle voltage CVDD by the resistance generates the common electrode voltage Vcom that determines flickering, so that the common electrode voltage Vcom is also varied linearly depending on the varying viewing angle voltage CVDD, thereby maintaining the image quality such as avoiding flicker.

Figure 8:
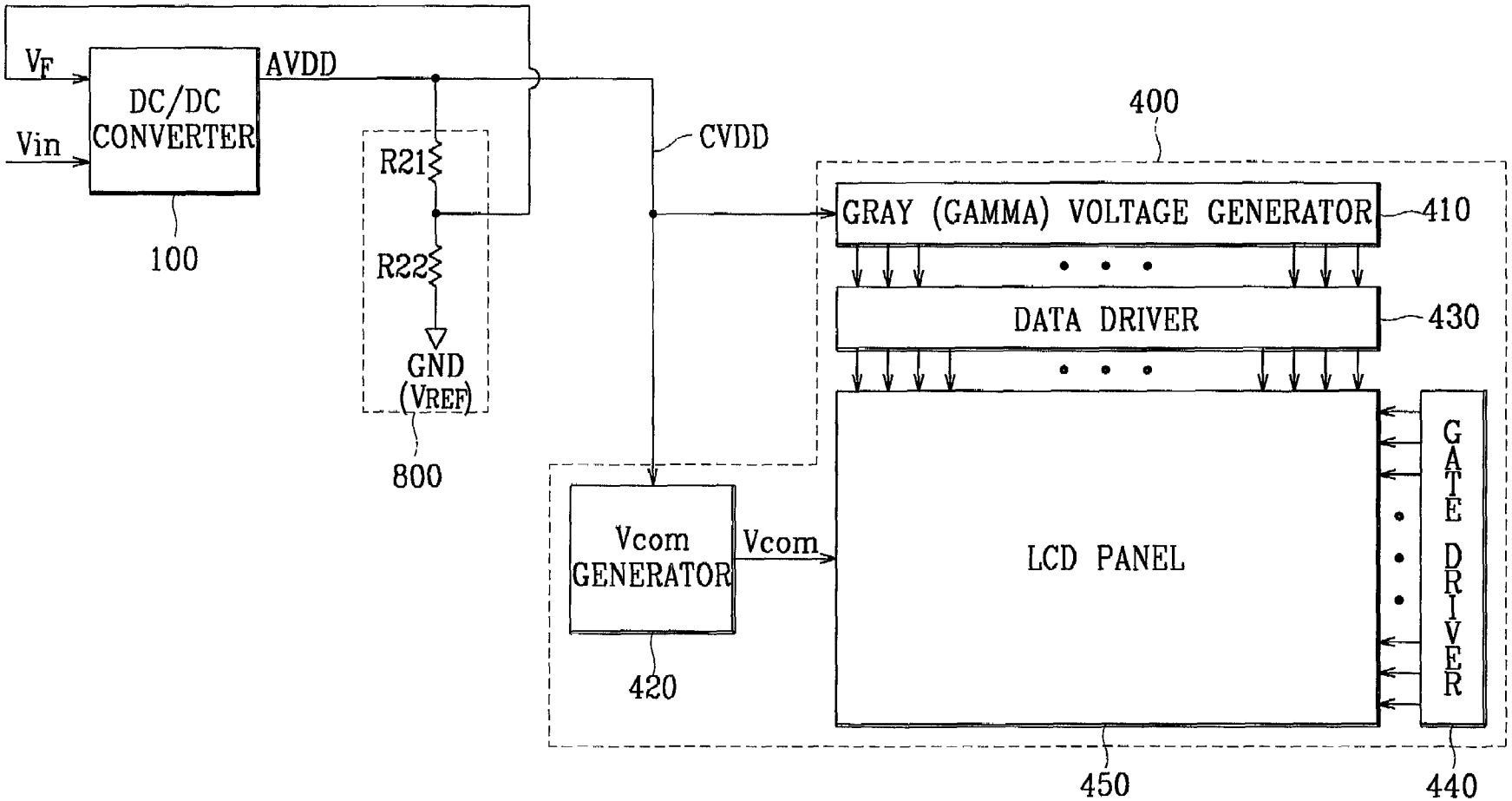
FIG. 8 is a diagram illustrating an LCD adaptive to a viewing angle in accordance with a fourth embodiment of the present invention.

Alternatively, as illustrated in FIG. 8, the analog driving voltage AVDD output from the driving voltage generator 100 may be used as information about the viewing angle.

FIG. 8 is a diagram illustrating an LCD adaptive to a viewing angle in accordance with a fourth embodiment of the present invention.

Referring to FIG. 8, the LCD adaptive to a viewing angle in accordance with the fourth embodiment of the present invention comprises a driving voltage generator 100, an LCD module 400, and a viewing angle generator 800. The LCD module 400 is understood by those skilled in the art.

The driving voltage generator 100 comprises a DC/DC converter and outputs a first voltage AVDD as an analog driving voltage based on an external input voltage Vin received via a first input and a feedback voltage VF via a second input.

The viewing angle generator 800 comprises serial resistors R21 and R22, the viewing angle generator 800 lowers the level of the first voltage AVDD by resistance-based voltage division based on the first voltage AVDD and a reference voltage (for example, ground), and feeds back the feedback voltage VF to the second input of the DC/DC converter. The viewing angle generator 800 also drops the level of the first voltage AVDD and supplies a second voltage CVDD to a gray voltage generator 410 and a common electrode voltage generator 420 of the LCD module 400.

In accordance with the fourth embodiment of the present invention as described above, a voltage for selecting a gamma curve based on the viewing angle of the LCD panel is output to the gray voltage generator 410 not only to control the gap between positive (+) and negative (−) gamma voltages and hence the transmissivity but also to supply the second voltage CVDD to the common electrode voltage generator 420 that determines flickering, thereby maintaining the image quality such as avoiding flicker.

Now, a detailed description will be given as to the operations of the driving voltage generator 100 and the viewing angle generator 800.

First, a comparative voltage is given by Equation 5.

$$V_a = \frac{R_{22}}{R_{21} + R_{22}} \cdot (AVDD - V_{REF}) + V_{REF} \qquad \text{[Equation 5]}$$

where Va is the constant comparative voltage in the DC/DC converter; AVDD the output voltage of the DC/DC converter of the driving voltage generator 100, $V_{REF}$ the reference voltage (e.g., ground), $R_{21}$ the divided voltage connected to AVDD, $R_{22}$ the divided voltage connected to $V_{REF}$.

Thus the output voltage of the AVDD of the DC/DC converter of the driving voltage generator is given by Equation 6.

$$AVDD = \frac{R_{21} + R_{22}}{R_{22}} \cdot \left(V_a - \frac{R_{21}}{R_{21} + R_{22}} \cdot V_{REF}\right) = \frac{R_{21} + R_{22}}{R_{22}} \cdot V_a - \left(\frac{R_{21}}{R_{22}} \cdot V_{REF}\right) \qquad \text{[Equation 6]}$$

As shown in Equation 6, either the resistor $R_{22}$ connected to the ground, or the reference voltage $V_{21}$, or both are varied based on the viewing angle to change the second voltage CVDD and select a gamma curve using the changed second voltage CVDD.

While this invention has been described in connection with what is presently considered to be the most practical and preferred embodiment, it is to be understood that the invention is not limited to the disclosed embodiments, but, on the contrary, is intended to cover various modifications and equivalent arrangements included within the spirit and scope of the appended claims.

As described above, the present invention detects the viewing angle of the LCD and determines the gamma curve based on the detected viewing angle, which solves the problem in regard to a reduction of the gray level caused due to a variation of the viewing angle and enables the user to enlarge the available range of the angle of viewing of the LCD panel.

Furthermore, the present invention varies the level of the common electrode voltage that determines flickering based on the detected viewing angle, thereby maintaining the image quality such as by reducing flickering.

What is claimed is:

1. A liquid crystal display (LCD), comprising:

a driving voltage generator receiving an input voltage and generating a first voltage and a second voltage;

a voltage divider converting a level of the second voltage based on a viewing angle of an LCD panel to generate a third voltage;

a viewing angle information generator receiving the first voltage and the third voltage and generating viewing angle information; and a gamma curve determiner selecting a liquid crystal gamma curve corresponding to the viewing angle information and controlling a gray level with a gamma voltage value based on the selected liquid crystal gamma curve.

2. The LCD as claimed in claim 1, wherein the first voltage is an analog driving voltage and the second voltage is a gate-on voltage.

3. The LCD as claimed in claim 1, wherein the voltage divider comprises a variable resistor variably generating a resistance value based on the viewing angle of the LCD panel, and outputs the third voltage using the variable resistor.

4. The LCD as claimed in claim 3, wherein a rotational axis of the variable resistor is connected to a hinge supporting an LCD module.

5. The LCD as claimed in claim 4, wherein the variable resistor is a dial type or a sliding type.

6. A liquid crystal display (LCD), comprising:

a driving voltage generator receiving an input voltage and generating a first voltage and a second voltage;

a decoder for decoding viewing angle data from a user;

a voltage divider comprising a plurality of resistors, selecting one of the resistors based on the decoded viewing angle data and converting a level of the second voltage based on the selected resistor to generate a third voltage;

a viewing angle information generator generating viewing angle information based on the first voltage and third voltage; and a gamma curve determiner selecting a liquid crystal gamma curve corresponding to the viewing angle information and controlling a gray level with a gamma voltage value based on the selected liquid crystal gamma curve.

7. The LCD as claimed in claim 6, wherein the first voltage is an analog driving voltage and the second voltage is a gate-on voltage.

8. A liquid crystal display (LCD), comprising:

a driving voltage generator receiving an input voltage and generating a first voltage;

a decoder decoding viewing angle data from a user;

a power selector comprising a plurality of voltage sources and selecting one of the voltage sources based on the decoded the viewing angle data to generate a second voltage;

a viewing angle information generator generating viewing angle information based on the first voltage and second voltage; and a gamma curve determiner selecting a liquid crystal gamma curve corresponding to the viewing angle information and controlling a gray level with a gamma voltage value based on the selected liquid crystal gamma curve.

9. The LCD as claimed in claim 8, wherein the first voltage is an analog driving voltage.

10. A liquid crystal display (LCD), comprising:

a driving voltage generator receiving an input voltage via a first input terminal and generating an analog driving voltage;

a viewing angle information generator generating viewing angle information by lowering a level of the analog driving voltage based on a viewing angle and feeding the analog driving voltage having the lowered level back to a second input terminal of the driving voltage generator; and a gamma curve determiner selecting a liquid crystal gamma curve corresponding to the viewing angle information and controlling a gray level with a gamma voltage value based on the selected liquid crystal gamma curve.

11. The LCD as claimed in claim 10, wherein the viewing angle information generator comprises:

a first resistor having a first terminal receiving the analog driving voltage; and a second resistor having a first terminal connected to a reference voltage or ground and a second terminal connected to a second terminal of the first resistor, to lower the level of the analog driving voltage.

12. The LCD as claimed in claim 11, wherein either the first resistor or a reference voltage is varied depending on the viewing angle of an LCD panel.

13. A method for liquid crystal display (LCD) gamma curve correction, comprising steps of:

plotting a plot of $[(AVDD-V_{CE}+V_{BE})/(Von-AVDD+V_{CE}-V_{BE})]\times R1$, wherein AVDD is a first voltage generated as an analog driving voltage, $V_{CE}$ is a collector-emitter electrode voltage, VBE is a base-emitter electrode voltage and R1 is a resistor; and adjusting an LCD gamma curve based on the plot.

14. A method of reducing flicker for a liquid crystal display (LCD) having a gamma curve, comprising the steps of:

plotting a plot of $[(AVDD-V_{CE}+V_{BE})/(Von-AVDD+V_{CE}-V_{BE})]\times R1$, wherein AVDD is a first voltage generated as an analog driving voltage, $V_{CE}$ is collector-emitter electrode voltage, $V_{BE}$ is a base-emitter electrode voltage and R1 is a resistor; and adjusting the LCD gamma curve based on the plot.

* * * * *